United States Patent [19]

Sasaki et al.

[11] 4,339,119

[45] Jul. 13, 1982

[54] PAPER SHEETS SEPARATING APPARATUS

[75] Inventors: Hiroshi Sasaki; Yoshio Ariga, both of Yokohama, Japan

[73] Assignee: Tokyo Shibaura Denki Kabushiki Kaisha, Kawasaki, Japan

[21] Appl. No.: 127,985

[22] Filed: Mar. 4, 1980

[30] Foreign Application Priority Data

| | | | |
|---|---|---|---|
| Mar. 13, 1979 | [JP] | Japan | 54-31236[U] |
| Mar. 15, 1979 | [JP] | Japan | 54-32362[U] |
| Mar. 15, 1979 | [JP] | Japan | 54-32363[U] |
| Mar. 15, 1979 | [JP] | Japan | 54-32364[U] |
| Mar. 15, 1979 | [JP] | Japan | 54-32365[U] |
| Mar. 15, 1979 | [JP] | Japan | 54-32366[U] |
| Mar. 15, 1979 | [JP] | Japan | 54-32367[U] |
| Mar. 15, 1979 | [JP] | Japan | 54-32368[U] |
| Mar. 26, 1979 | [JP] | Japan | 54-37859[U] |
| Apr. 4, 1979 | [JP] | Japan | 54-39755[U] |

[51] Int. Cl.[3] ..... B65H 29/44; B65H 31/32; B65H 31/20

[52] U.S. Cl. ..... 271/180; 271/189; 271/208; 271/218; 271/223

[58] Field of Search ..... 271/218, 189, 208, 180, 271/181, 177, 223, 224, 217, 219, 171; 414/50, 91

[56] References Cited

U.S. PATENT DOCUMENTS

| | | | |
|---|---|---|---|
| 965,375 | 7/1910 | Dean | 271/180 |
| 3,233,891 | 2/1966 | Denton et al. | 271/218 X |
| 3,285,607 | 11/1966 | Lindemann | 271/218 |
| 3,892,168 | 7/1975 | Grobman | 271/218 X |

FOREIGN PATENT DOCUMENTS

| | | | |
|---|---|---|---|
| 2631847 | 1/1978 | Fed. Rep. of Germany | 271/208 |
| 944866 | 12/1963 | United Kingdom | 271/218 |
| 1532019 | 11/1978 | United Kingdom | 271/218 |
| 217350 | 10/1972 | U.S.S.R. | 271/218 |

*Primary Examiner*—Bruce H. Stoner, Jr.
*Attorney, Agent, or Firm*—Cushman, Darby & Cushman

[57] ABSTRACT

A paper sheets processing apparatus including a plurality of rod-like separators extending normally and horizontally into a paper sheets stacking chamber, said separators being rockable from their normal position to a position slanted upward by a certain angle as well as retractable in the longitudinal direction; and a plurality of beat members disposed at the upper portion of the stacking chamber so as to swing within a certain angle range and serving to forcedly beat down every paper sheet fed into the stacking chamber.

7 Claims, 10 Drawing Figures

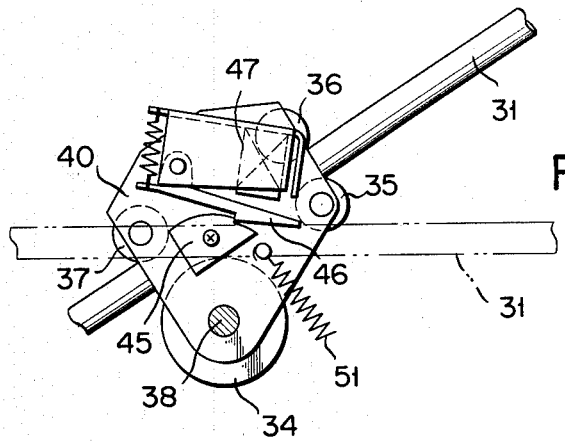
FIG. 5
FIG. 6
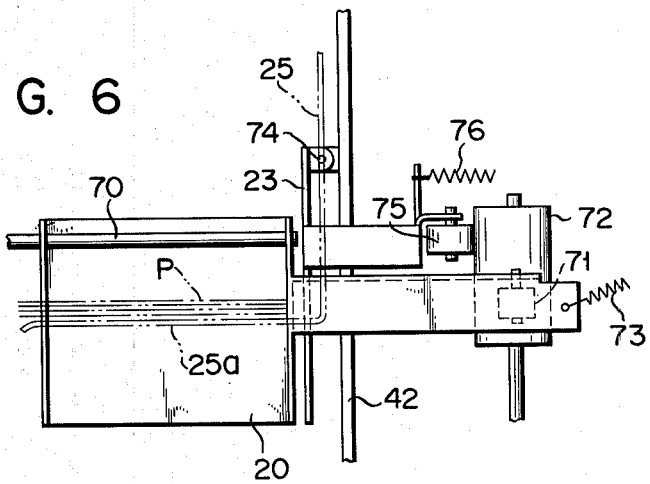
FIG. 7
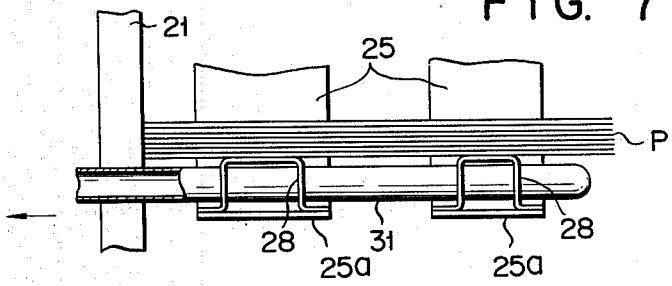

PAPER SHEETS SEPARATING APPARATUS

BACKGROUND OF THE INVENTION

The present invention relates to an apparatus for processing paper sheets such as bank notes, checks, share certificates and advice slips. More particularly, the present invention relates to a paper sheets separating apparatus for separating and stacking paper sheets in bundles of a predetermined number.

Separating apparatus of this type are usually employed in the sorting system for sorting paper sheets into normal sheets which can be recirculated and into non-recirculated sheets which have become broken and dirty.

Sorting systems are known in the art and FIG. 1 shows as an example, a well known sorting system. Paper sheets to be sorted, such as for example, bank notes (a) are stacked in groups of 1,000 sheets, for example, in a supplying portion (b) of the system. These paper sheets (a) are taken out one by one from the supplying portion (b) by means of a taking-out roller (c) and transported by a carrying belt assembly (d) to pass through paper sheets detecting devices (e, f) during their transport. Paper sheets (a) are sorted at gates (g, h) according to the discriminations or detections effected by detecting devices (e, f).

One group of sorted paper sheets is fed into a particular collecting pocket (i) while the other group of sorted paper sheets are fed into corresponding separating apparatus (j and k).

Paper sheets (a) fed into separating apparatus (j, k) are separated and stacked every predetermined number thereof, for example, every 100 sheets in each of separating apparatus to be discharged onto a carrier means (l) arranged under separating apparatus.

Stacked paper sheets discharged onto the carrier means (l) from respective separating apparatus (j, k) are carried to a bundling device (m), where every stack of paper sheets is bundled by a tape and then discharged from the sorting system.

Well known separating apparatus as described above have the following structure, for example. A paper sheets placing plate, movable up and down, is disposed in a stacking chamber of the apparatus and a separator is also disposed above the paper sheets placing plate to freely move into and out of the stacking chamber.

Paper sheets successively fed one by one into the stacking chamber are stacked on the separator. When paper sheets thus stacked reach a predetermined number, the separator is moved to a position outside the stacking chamber causing stacked paper sheets to drop onto the paper sheets placing plate disposed thereunder.

Then, the separator returns to a position inside the stacking chamber and a predetermined number of paper sheets is stacked thereon again.

Stacked paper sheets dropped onto the paper sheets placing plate are removed from the paper sheets placing plate by a means arranged in the carrier device (l).

Another well known separating apparatus disclosed in the British Pat. No. 1,532,019 has a normally horizontally disposed rockable separator on which paper sheets brought into the stacking chamber are placed one atop another. When the stack of paper sheets is finished, the separator, being kept substantially horizontal, is drawn out of the stacking chamber by means of a link mechanism, rocked with a predetermined angle slanted upward, outside the stacking chamber, and moved in slanted orientation into the stacking chamber. The separator is then shifted from the rocked position to the original horizontal position inside the stacking chamber, thus allowing a subsequent stacking process of paper sheets to be started again.

However, conventional separating apparatus as described above have such disadvantages that the feeding speed of paper sheets into the stacking chamber cannot be enhanced to a substantial extent because of the retreating and forwarding speed of the separator and that the attempt to enhance the retreating and forwarding speed of the separator makes the driving mechanism of the apparatus more complicated.

In addition, conventional separating apparatus are not provided with a particular means which functions to positively feed paper sheets into the stacking chamber and leave paper sheets to drop by their own weight, so that a high speed feeding of paper sheets cannot be achieved and paper sheets cannot be satisfactorily stacked in order.

Moreover, in the case of conventional separating apparatus the space of the stacking chamber is confined to have a fixed area capable of receiving a paper sheet having the largest width and length to be accommodated, thus causing paper sheets of smaller size not to be stacked in order in the stacking chamber.

SUMMARY OF THE INVENTION

The object of the present invention is to provide an improved paper sheets separating apparatus capable of positively separating paper sheets into groups of a predetermined number, each of the paper sheets being continuously fed at a high speed and over a short interval, and stacking the paper sheets in order in a stacking chamber.

In order to achieve this object, the separating apparatus of the present invention is provided with a separator, which is drawn out of the stacking chamber before a predetermined number of paper sheets are stacked thereon, moved upward with the stacking chamber oriented with a predetermined angle maintained relative to the horizontal line and set to a rocked position while paper sheets are being stacked thereon to the predetermined number, and then shifted from the rocked position to its original horizontal position at the same time when paper sheets have been stacked to the predetermined number to thereby separate stacked paper sheets from newly fed ones.

Therefore, the feeding speed of paper sheets can be made high speed independent of the operating speed of the separator.

In addition, the apparatus of the present invention is provided with an intermittently driven beat member, which serves to positively drop paper sheets into the stacking chamber and is adapted to operate synchronously with the timing at which paper sheets are fed, thus allowing paper sheets to be stacked in the stacking chamber quickly and in order.

Moreover, the apparatus of the present invention allows the width and length of the stacking chamber to be adjusted according to the sizes of paper sheets to be fed thereinto. Therefore, paper sheets can be always stacked in order and paper sheets thus stacked can be carried with certainty from the apparatus to a transported device to thereby make a subsequent bundling process easy.

BRIEF DESCRIPTION OF THE DRAWINGS

The object and merits of the present invention will be apparent from the following detailed description with reference to the accompanying drawings.

FIG. 5 is a partial view showing a rock mechanism for a separator;

FIG. 6 is a partial view viewed from the same side as in FIG. 4 and showing a vibration adding mechanism for paper sheets;

FIG. 7 is a partial view showing an elevating member and a separator;

DETAILED DESCRIPTION OF THE PREFERRED EMBODIMENT

Figure 1:
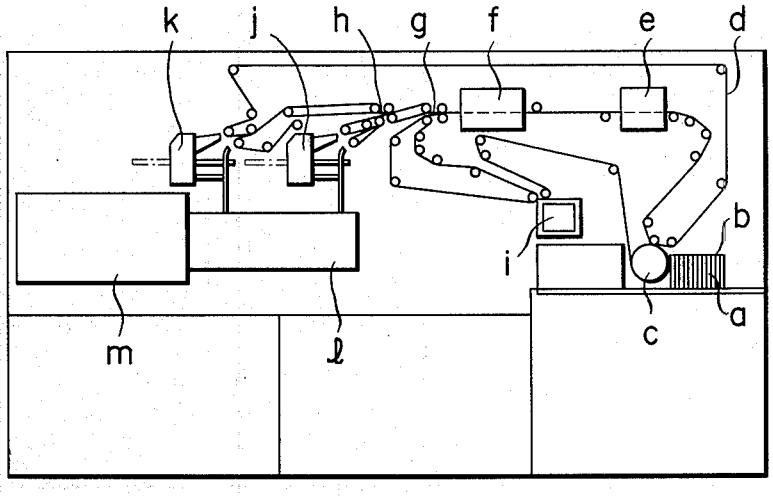
FIG. 1 PRIOR ART
FIG. 1 is a schematic view of the general arrangement of a paper sheet-sorting system whose separating apparatus may be substituted by that of the present invention.

Bank notes are used herein as paper sheets (which will be hereinafter referred to by reference character P) to be processed.

Figure 2:
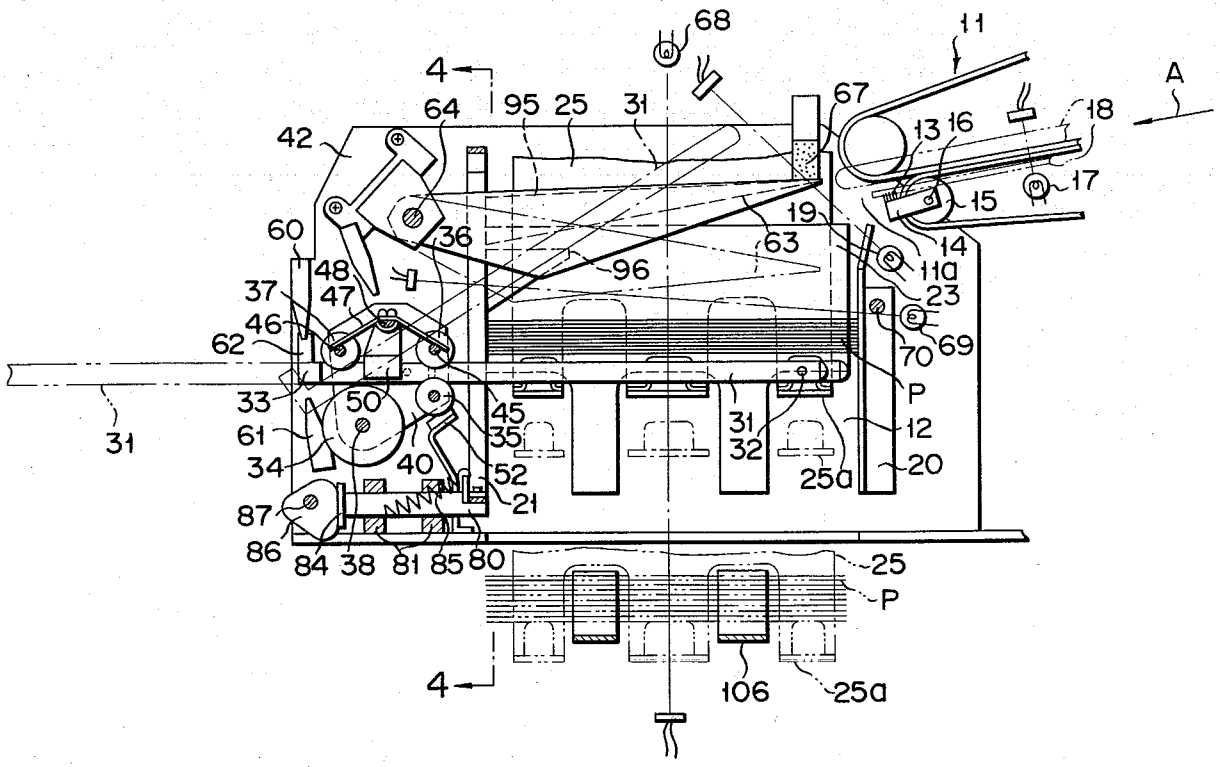
FIG. 2 is a view of the separating apparatus of the invention partly broken away and sectioned along the line 2-2 in FIG. 3.

In FIG. 2, paper sheets P are fed into a stacking chamber 12 by means of a roll-and-belt feed assembly 11 which forms a paper sheets introducing means. At the paper sheets introducing end 11*a* of the assembly 11 is arranged a static electricity removing member 13 comprising a brush. A bracket 14 for supporting the member 13 is fixed to a rod 16 for supporting a roller 15.

Paper sheets P are fed as shown by an arrow A in FIG. 2 by means of the feed assembly 11 and detected at a point of the feeding way by means of an optical detector 17 consisting of a lamp and phototransistor. When fed from an introducing end 11*a* into the stacking chamber 12, each of paper sheets P is guided by a guide member 18 shown by a two-dots-and-dash line in FIG. 2 in such a manner that each of paper sheets P is curved to have rigidity. And at this time of being fed on this portion, the underface of each of paper sheets slides on the static electricity removing member 13 to thereby remove static electricity from each of paper sheets. Static electricity removed from the paper sheets flows from the member 13 to earth. Paper sheets P are also detected at a point adjacent to the introducing end 11*a* by another optical detector 19 consisting of a light source and a phototransistor.

In FIG. 2 the right and left direction along the sheet of the drawing defines a longitudinal direction and the direction perpendicular to the sheet of the drawing defines a crosswise direction.

One of the crosswise walls of the rectangular chamber 12 is a vibration plate 20 extending vertically while the other is a movable wall plate 21. One of the longitudinal walls of the stacking chamber 12 is a door member 22 made of synthetic resin, while the other is another vibration plate 23, as shown in FIG. 3.

Figure 3:
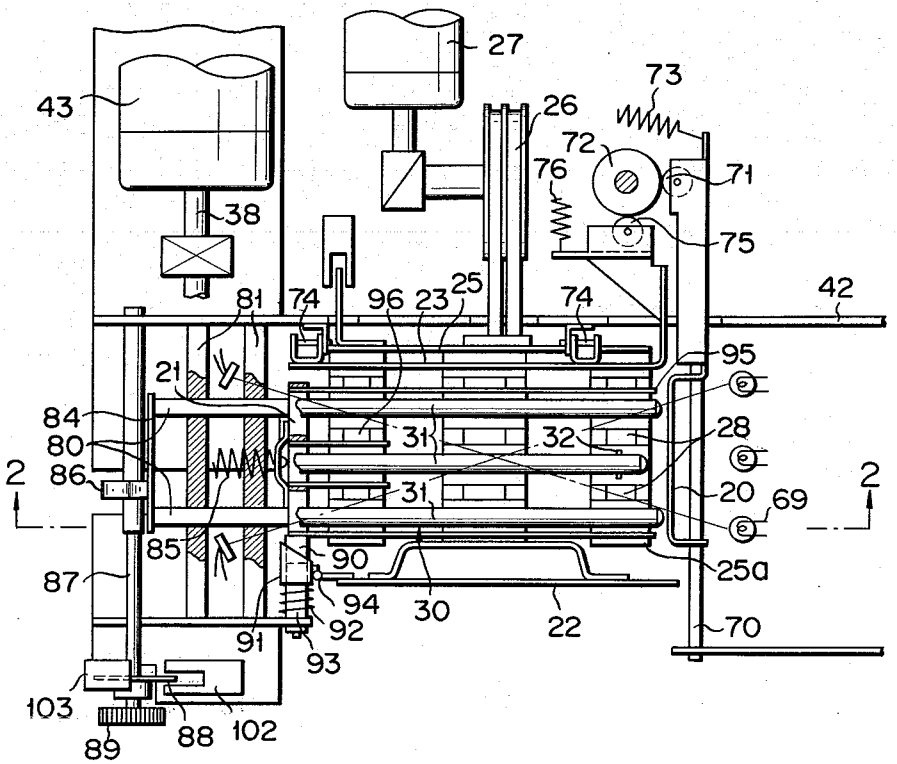
FIG. 3 is a top view of the apparatus shown in FIG. 2.

An elevating member 25, movable up and down, is arranged in the stacking chamber 12 and moved vertically by a driving motor 27 through a belt-and-pulley assembly 26 shown in FIG. 3. The elevating member 25 is stopped at an upper position shown by a solid line in FIG. 2, a middle position slightly lowered from the upper position and shown by a dot-and-dash line, and a lower position lowered to the utmost extent and shown by a two-dots-and-dash line, and driven to move from the upper position to the lower position and vice versa.

The elevating member 25 is of substantially L-shape as shown by a two-dots-and-dash line in FIG. 6 and its horizontal portion 25*a* is defined to form a plate on which paper sheets are stacked. The horizontal plate 25*a* comprises three band plates extending in fork shape and each of the band plates has plural supporting brackets 28 welded on the upper face thereof with a space therebetween. The upper faces of brackets are horizontal and maintained at a same level.

At the middle of the stacking chamber 12 is located horizontally as shown in FIG. 3 a separator assembly 30 comprising rod-like members of three hollow pipes or tubes. The foremost end of each of separator rods 31 extends to come near the vibration plate 20 and is closed to have a round tip. Three rods 31 are arranged parallel with a space interposed therebetween. A pair of stop pins 32 project crosswise from the portion of the center rod 31 adjacent the foremost end thereof.

When separator rods 31 are in their normal horizontal position and the elevating member 25 in its upper position, the upper face of each of brackets 28 projects a little above the upper rims or rods 31. This is clearly shown in FIG. 7.

Back ends of separator rods 31 are connected together outside the stacking chamber 12 by means of a connecting member 33, thus allowing the three rods to move in the same way.

Separator rods 31 are in contact with a common friction roller 34 of larger diameter arranged crosswise outside the stacking chamber 12. Each of the rods is guided and supported by a roller assembly consisting of three guide rollers 35, 36 and 37, and slidingly driven in the longitudinal direction under friction by the rotation of the friction roller 34.

Figure 4:
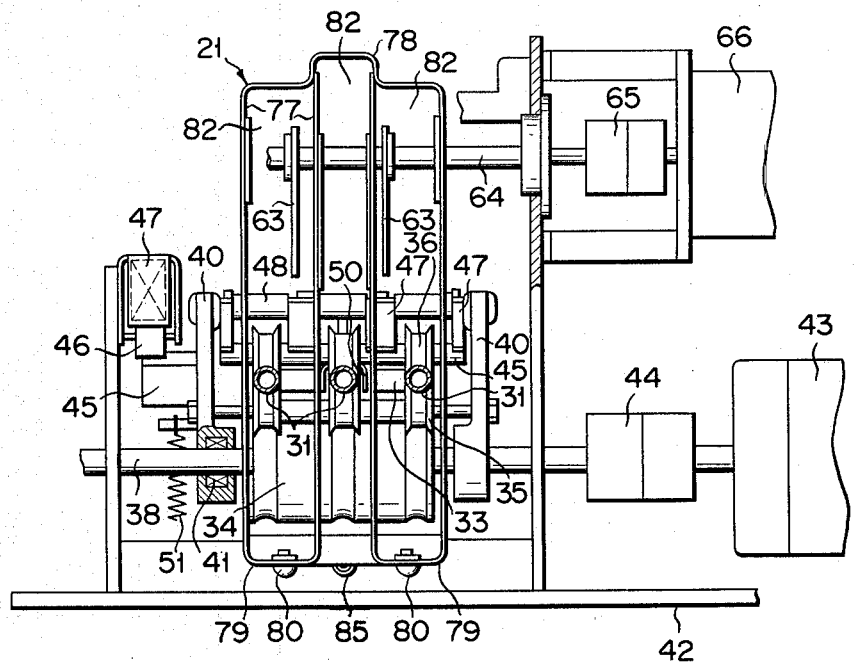
FIG. 4 is a view of the apparatus sectioned along the line 4-4 in FIG. 2.

A common shaft of the rollers 35 is supported at the both ends thereof by means of a pair of supporting arm plates 40. As shown in FIG. 4, each of arm plates 40 is rockably attached through a bearing 41 to the shaft 38 of the friction roller 34. The shaft 38 of the friction roller 34 is further supported by a fixed frame 42 of the apparatus and connected at one end thereof through a coupling 44 to a reversible driving motor 43.

Shafts 45 and 46 of guide rolls 36 and 37 are supported by leaf springs 47 and pressed onto the upper rim of the corresponding rod 31 by the action of leaf springs 47. The end portion of a side frame 48 supporting leaf springs 47 is fixed to the corresponding arm plate 40. To the side frame 48 is attached a stirrup-like stop member 50, which comes near from above the center rod 31 facing the passage through which stop pins 32 move. Therefore, as shown by a two-dots-and dash line in FIG. 2, separator rods 31 are slidingly retreated in the longitudinal direction following the rotation of the friction roller 34 until stop pins 32 engage the stop member 50.

The arm plate 40 is always urged clockwise in FIG. 2 by a spring 51 shown in FIGS. 4 and 5, but separator rods are kept horizontal against the action of the spring 51 thanks to the engagement between the guide roller 35 and an abut member 52 attached to the fixed frame 42.

When the friction roller 34 is further rotated counterclockwise in FIG. 2, separator rods cannot move in the longitudinal direction and the arm plate 40 is therefore rocked counterclockwise around the shaft 38 against the action of the spring 51, so that separator rods 31 are slanted upward as shown by a dot-and-dash line in FIG. 2. This position is called rocking position.

A mechanism for temporarily locking separator rods 31 at a slanted angle position is shown in FIG. 5. Namely, when separator rods 31 reach a predetermined angle position, a latch member 46 is engaged with a toothed member or pawl 45 fixed to the arm plate 40, thereby locking the separator rods 31 at the rocking position. The latch member 46 is operated by an electromagnet 47 attached to the fixed frame 42 and when the latch member 46 is drawn by the energized electromagnet 47, the engagement between the latch member 46 and the toothed member 45 is released and the arm plate 40 is rocked clockwise by the action of the spring 51 to thereby cause separator rods 31 to return to the normal position.

The position of separator rods 31 is detected by sensors 60 and 61 arranged at suitable points on the frame 42. A detecting element 62 cooperating with these sensors is arranged on the back end of the center separator rod 31.

Above the stacking chamber 12 are disposed a pair of beat members 63 extending horizontal in the longitudinal direction and with a space interposed therebetween. These beat members 63 are supported at the back ends thereof by a common driving shaft 64 outside the stacking chamber 12 and made of metal plate whose face is along the vertical line and of a shape having a tapered free front end, as shown in FIG. 2.

As shown in FIG. 4, the driving shaft 64 is connected via a coupling 65 to a rotary solenoid 66 and rocked by the excitation of the solenoid 66 between a rest position shown by a solid line in FIG. 2 and a beating position shown by a two-dots-and-dash line to thereby forcedly beating down paper sheets P fed into the stacking chamber 12. Therefore, the rocking timing of beat members is synchronized with the timing at which each of paper sheets is fed into the stacking chamber 12.

Each of beat members 63 while in the rest position contacts at the foremost end thereof a buffer member 67 which serves to reduce noise which occurs at the time when beat members are rocked.

There are further provided optical detecting means 68 and 69 consisting of a light source and a phototransistor and detecting whether or not paper sheets P are present in the stacking chamber 12. The detecting means 68 scans a vertical direction (see FIG. 2), while the other detecting means 69 scans a direction slightly inclined to the horizontal direction (see FIGS. 2 and 3).

There will be now described the means for adding vibration to paper sheets P.

Vibration plate 20 adds vibration to paper sheets P in the longitudinal direction and the other vibration plate 23 adds vibration in the crosswise direction while paper sheets P are falling into the stacking chamber 12 and when positioned on the bottom of the stacking chamber 12, thus assisting in stacking paper sheets P in order in the stacking chamber 12.

Vibration plate 20 is rockable around a shaft 70 supported by the fixed frame 42 and a follower roll 71 attached to the extension of the vibration plate 20 contacts an eccentric driving roll 72 in such a manner that the follower roll 71 is urged onto the eccentric driving roll 72 by a spring 73.

Therefore, when the roll 72 is rotated, the vibration plate 20 is repeatedly vibrated around the shaft 70.

The other vibration plate 23 is pivotally mounted via pins 74 to the fixed frame 42 and a follower roll 75 attached to the extension of the vibration plate 23 is urged onto the eccentric driving roll 72 by a spring 76.

Therefore, the rotation of the roll 72 causes the vibration plate 23 to be repeatedly vibrated.

The lower end portion of the vibration plate 23 is formed in forked shape allowing the forked horizontal plate **25*a* of the elevating member 25 to freely pass through therebetween, so that no interference is caused between the vibration plate 23 and the elevating member 25**.

Vibration adding means described above are adapted to add vibration to paper sheets P before paper sheet P are stacked on separator rods 31, namely while they are falling onto separator rods 31, thus making it surer to stack them in order.

There will be now described the mechanism for adjusting the size of the stacking chamber 12 in the longitudinal and crosswise directions.

The vertical wall frame 21 includes vertical legs 77 made of band plates and arranged parallel each other with a space interposed therebetween, and an upper lateral leg 78 connecting the upper end portions of vertical legs 77. Each two of legs 77 is connected to each other at the lower end portions thereof by a lower lateral leg 79 which is fixed to a supporting rod 80 extending in the longitudinal direction. Each of supporting rods 80 is passed through two blocks 81 so as to slide in the horizontal direction.

Between four vertical legs 77 are defined ample spaces into which separator rods 31 and beat members 63 are allowed to extend. As shown in FIG. 4, separator rods 31 and beat members 63 are formed to be staggered from one another in the crosswise direction to thereby cause no interference therebetween and to keep separator rods and beat members rockable.

Four vertical legs 77 are registered one another at their ends facing the stacking chamber 12 as if they provide a vertical wall face relative to paper sheets P.

Free ends of paired supporting rods 80 are connected one another by a follower member 84 arranged crosswise, and the follower member 84 is pressedly urged onto a selection cam 86 by a spring 85 anchored to the wall frame 21.

The selection cam 86 can rotate integral to a shaft 87 and on the circumferential surface of the selection cam 86 are provided three cam faces each different in height from the center of the shaft 87. The shaft 87 is supported by the fixed frame 42 as shown in FIG. 3 and to the extended end portion thereof are attached a control disk 88 and a manually operated knob 89, respectively.

When the knob 89 is turned by the operator, one of three cam faces of the cam 86 can be caused to correspond to the follower member 84. Therefore, the wall frame 21 slides parallel in the horizontal direction through supporting rods 80 to thereby adjust the size of the stacking chamber 12 in the longitudinal direction.

In FIG. 3, wall frame 21 is shown fixed to a first block 90 having a tapered cam face and a second block 91 having a tapered cam face corresponding to the one of the first block 90 is supported by a short shaft 92. The second block 91 is made hollow, slidably inserted onto the short shaft 92 and urged toward the first block 90 by a spring 93 to bring both tapered faces into engagement. The short shaft 92 is fixed to the fixed frame 42.

To the second block 91 is connected via a hinge 94 the door 22 whose face is usually kept along the longitudinal direction, as shown in FIG. 3.

When the wall frame 21 slides by the rotation of the selection cam 86, the first block is also shifted. However, the second block 91 is not moved in the longitudinal direction since the second block is mounted on the short shaft 92. As the result, the second block is shifted in the axial direction of the short shaft 92 keeping both cam faces engaged by the action of the spring 93, so that the door 22 is also moved parallel in the crosswise direction.

Door 22 is associated with the wall frame 21 by the cam action of first and second blocks 90 and 91. Accordingly, the size of the stacking chamber 12 is automatically adjusted in both longitudinal and crosswise directions according to the size of paper sheets to be processed. As an alternative, door 22 may be adjusted independent of the movement of the wall frame 21.

To two vertical legs 77 of the wall frame 21 are fixed upper guide plates 95 and to the other two legs thereof lower guide plates 96. Upper guide plates 95 have a shape similar to that of beat members 63, as shown in FIG. 2, and extend long while lower guide plates 96 extend short. These guide plates 95 and 96 serve to guide downward paper sheets P discharged from the introducing means 11.

These plates 95 and 96 are also arranged along the vertical line and staggered in the crosswise direction from separator rods 31 and beat members 63 to thereby cause no interference among them. This is a newly-devised interdigitate structure.

The control disk 88 has two arcuate slits 100 and 101 spaced from each other and extending along the circumference thereof. Corresponding to each of slits, two sensors 102 and 103 are arranged with a space interposed therebetween around the disk 88. Each of sensors is attached to the fixed frame 42 comprising a lamp and a phototransistor, which are located opposite with the disk 88 interposed therebetween. When the sensor is in a position corresponding to the slit, a signal of logic level (o) corresponding to "light" is generated while when not in the above-mentioned position, a signal of logic level (1) corresponding to "dark" is generated.

Figure 9:
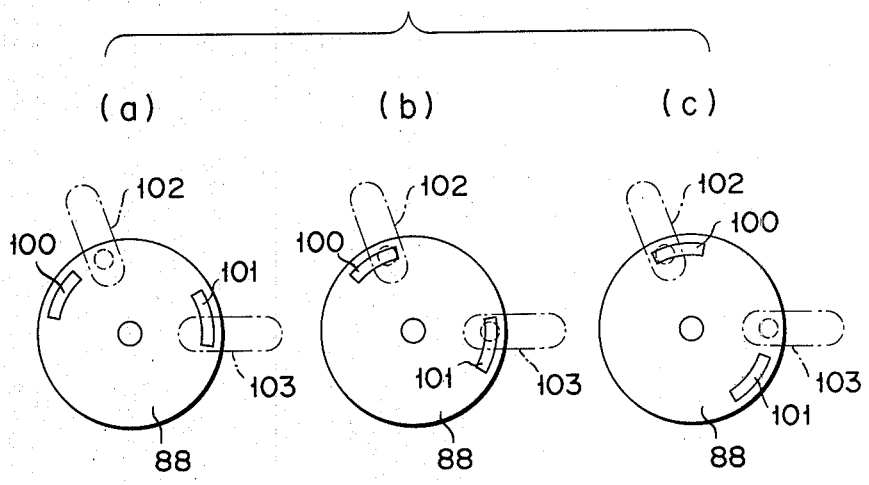
FIGS. 9(*a*), 9(*b*) and 9(*c*) show how a disk and sensors are selectively positioned, said disk being selectively rotated and controlled according to the kinds of paper sheets.

FIGS. 9(*a*), 9(*b*) and 9(*c*) show three different positions of the rotating disk 88. As is apparent from these Figures, the combination of signals showing "light" and "dark" and applied from sensors 102 and 103 becomes different every position of the rotating disk 88 corresponding to the positional relation between two slits 100, 101 and sensors 102, 103.

Figure 8:
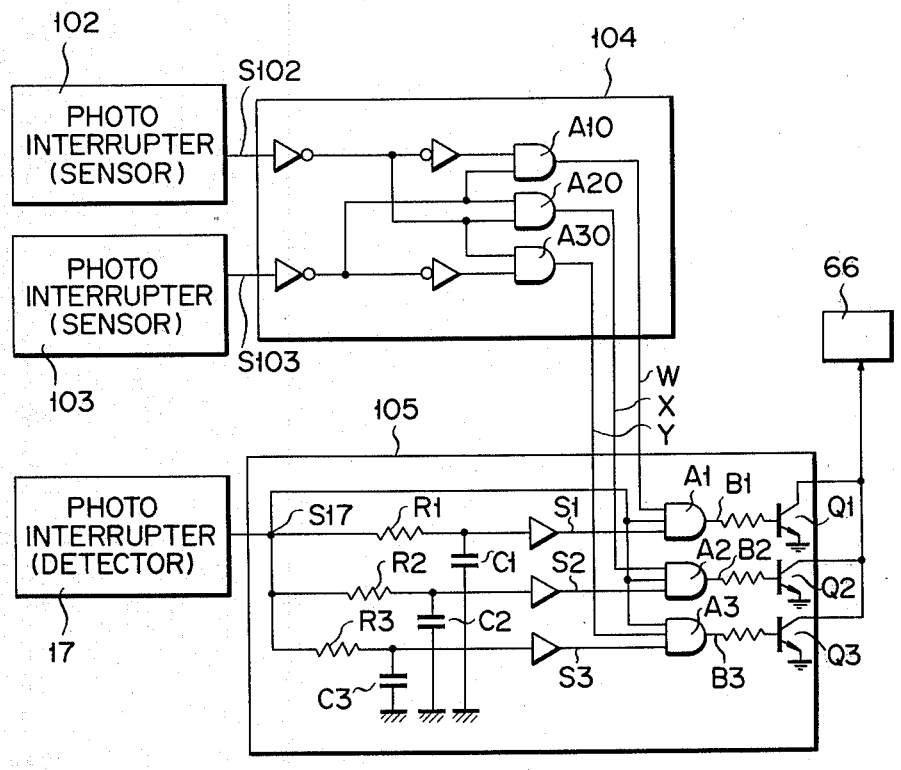
FIG. 8 is a circuit diagram showing the relation between the timing at which a beat member employed in the apparatus of the present invention is driven and the feeding detection of paper sheets.
Figure 10:
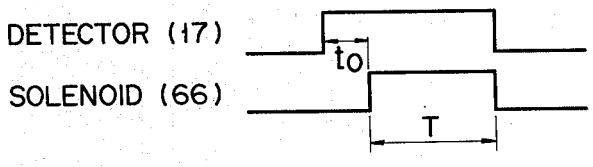
FIG. 10 is a timing diagram associated with the circuit shown in FIG. 8.

In FIG. 8, the signal S102 or S103 applied from each of sensors 102 and 103 showing "light" or "dark" is converted in a signal combination circuit 104 into three different signals W, X and Y, which are applied to a beat driving circuit 105. The circuit 105 is intended to drive the rotary solenoid 66 for beat members 63 and connected to the detector 17 arranged adjacent to the paper sheets introducing means 11. The circuit 105 receives a signal S17 sent from the detector 17 every time when each of paper sheets P passes through the detector 17 and drives, as shown in FIG. 10, the rotary solenoid 66 with a delay $t_o$ as measured from the issue of said signal S17 for a length of time expressed as T. The beat driving circuit 105 operates so as to make the length of the time delay $t_o$ different according to positions of the rotating disk as shown in FIGS. 9(*a*), 9(*b*) and 9(*c*). The length of the time delay $t_o$ is determined by time constants R1C1, R2C2 and R3C3 in the circuit 105.

The reason why the delay time $t_o$ is set is that it takes a little time for each of paper sheets P to move from the detector 17 to the position in which the paper sheet to be fed is placed suitable for being beaten by beat members 63.

When the size of paper sheets P while being processed is different from that of paper sheets to be processed by subsequent process, the wall frame 21 is shifted in the horizontal direction by the above-mentioned adjusting mechanism, and the position in which paper sheets to be processed by the subsequent process is changed a little according to the shift of the wall frame 21. It is also desirable therefore to change the beating manner of beat members.

When the wall frame 21 is adjusted to narrow the stacking chamber 12 in the longitudinal direction in FIG. 2, for example, it is desirable for beat members to beat each of paper sheets P at a faster timing. If not, paper sheets P may impinge onto the wall frame 21 to thereby make it easier for paper sheets P to be damaged and for the in-order stacking of paper sheets P to be hindered. Therefore, in this case the beat driving circuit 105 operates so as to make smaller the delay time.

There will be now described with reference to FIG. 8 the circuit for driving the rotary solenoid 66.

Each of sensors 17, 102 and 103 may comprise a conventional photo-interrupter. The sensor 17 generates the signal of logic "1" when the light thereof is interrupted by one of paper sheets P. Sensors 102 and 103 generate signals S102 and S103 each being of logic "0" when their lights are allowed to pass through either of the slit 100 or 101.

When the sensor 17 does not detect of the paper sheet, i.e. S17 logic "0", AND gates A1-A3 are all closed. Namely, NPN transistors Q1-Q3 biased by outputs B1-B3 of AND gates A1-A3 are all turned OFF. On the other hand, when the sensor 17 detects the paper sheet, i.e. S17 logic "1", one of AND gates A1-A3 is opened according to the combination of signals S102 and S103 sent from sensors 102 and 103. In other words, when the signal S17 becomes equal to logic "1", one of NPN transistors Q1-Q3 is turned ON at a predetermined timing according to the logic level of signals S102 and S103 to thereby drive the rotary solenoid 66 by the collector current of the transistor.

TABLE 1

| | FIG. 9(a) | FIG. 9(b) | FIG. 9(c) |
|---|---|---|---|
| S102 | 1 | 0 | 0 |
| S103 | 0 | 0 | 1 |
| W | 1 | 0 | 0 |
| X | 0 | 1 | 0 |
| Y | 0 | 0 | 1 |
| B1 | 1 | 0 | 0 |
| B2 | 0 | 1 | 0 |
| B3 | 0 | 0 | 1 |
| Transistor to | Q1 | Q2 | Q3 |

TABLE 1-continued

| | FIG. 9(a) | FIG. 9(b) | FIG. 9(c) |
|---|---|---|---|
| be turned ON Whether or not solenoid 66 operates | Yes | Yes | Yes |
| Factor on which is determined | R1C1 | R2C2 | R3C3 |

Table 1 shows the operating modes of the logic circuit shown in FIG. 8 corresponding to each of FIGS. 9(*a*), 9(*b*) and 9(*c*). In the table 1, the logic "1" of outputs B1-B3 is obtained after the signal S17 becomes equal to logic "1" and the predetermined time lapses, as shown in FIG. 10. This predetermined time can be determined on the ground of time constants R1C1, R2C2 and R3C3. The following becomes apparent from the table 1. When slits 100 and 101 are in the position shown in FIG. 9(*a*), S102 logic "1" and S103 logic "0". In this case, it is only the one A10 of AND gates in the circuit 104 that is opened. Therefore, logic levels of outputs of AND gates A10, A20 and A30 become equal to "1", "0" and "0", respectively. Since both of outputs X and Y equal to logic "0", AND gates A2 and A3 are always closed. On the other hand, when a signal S1 applied to the AND gate A1 becomes equal to logic "1" after the signal S17 becomes equal to logic "1" and then after the lapse of a time delay corresponding to the time constant R1C1, the AND gate A1 is opened. Therefore, an output B1 of the AND gate A1 becomes equal to logic "1" and the transistor Q1 is turned ON by this logic "1" to thereby drive the rotary solenoid 66. Namely, the rotary solenoid 66 is operated after the lapse of the predetermined time corresponding to the time constant R1C1 from the instant at which the signal S17 has become equal to logic "1".

Similarly, in the case of FIG. 9(*b*), the rotary solenoid 66 is operated after the lapse of the time corresponding to the time constant R2C2 from the instant at which the signal 17 has become equal to logic "1". In the case of FIG. 9(*c*), the rotary solenoid 66 is operated after the lapse of the time corresponding to the time constant R3C3.

As apparent from the above and the table 1, the rotary solenoid 66 is operated after the lapse of a predetermined time from the instant at which the sensor 17 has detected the paper sheet (S17=logic "1"). And the operating timing of the solenoid 66 can be freely determined or changed according to the time constant R1C1, R2C2 or R3C3.

There will be now described the operation of the separating apparatus of the present invention in which paper sheets P are separated every 100 sheets, for example.

When paper sheets P are continuously fed one by one into the stacking chamber 12 by means of the introducing means 11, it is set at the first step that separator rods 31 are located in their normal position shown by the solid line in FIG. 2 and that the elevating member 25 is located lower than its upper position, to thereby keep the upper face of each of supporting brackets 28 lower than upper rims of separator rods.

Paper sheets P while falling into the stacking chamber are beaten one by one by beat members 63 to fall onto rods 31, where paper sheets P are subjected to the action of vibration adding means to be stacked in order on rods. At the stage where paper sheets P stacked reach a number of from 20 to 30 sheets, separator rods 31 are drawn out of the stacking chamber 12 by the rotation of the friction roller 34. At this time the elevating member 25 has been lifted to its upper position and, therefore, paper sheets stacked are practically supported by supporting brackets 28. Thus, separator rods 31 can slide without being subjected to the weight and friction of paper sheets stacked. This is also preferable because rods 31 give no hindrance to paper sheets stacked.

When the center rod 31 is stopped by the engagement between the pin 32 and the stop member 50, rods 31 are automatically rocked and locked in rocked state.

At the stage where paper sheets stacked reach a number of from 70 to 80 sheets, separator rods 31 in their rocked position is slided into the stacking chamber and to the position shown by the dot-and-dash line in FIG. 2 by the reverse rotation of the friction roller 34. When in this slanted position, rods 31 are out of the way through which paper sheets are falling into the stacking chamber.

The elevating member 25 is lowered to its middle position.

At the instant at which 100th paper sheet has fallen, the latch member 46 of the locking mechanism is disengaged from the pawl 45 by the excitation of the solenoid 47. Thus, separator rods 31 quickly fall by the action of spring 51 from their rocked position to their normal position, to thereby separate a subsequently falling 101st paper sheet from 100 paper sheets already stacked.

The thickness of paper sheets stacked on the elevating member 25 is considerably large, but since the member 25 has been lowered to its middle position, rods 31 return back to their normal position without being subjected to any influence of paper sheets. And on these separator rods 31 is newly stacked a subsequent member of 100 paper sheets.

The separated stack of 100 paper sheets is further lowered by the elevating member 25 to the lower position thereof. Then, taking-out members 106 of the carrier means move crosswise corresponding to the stack of 100 paper sheets and take out the stack from on the elevating member 25.

Thereafter, the elevating member 25 is again lifted to start the subsequent separating operation.

In the description of the preferred embodiment the selective rotation angle range of the cam 86 is larger than that of the control disk 88. Therefore, both ranges must be practically made equal each other. To achieve this object, an angle changing mechanism such as gears which is omitted in FIG. 3 is attached to the shaft 87 between the cam 86 and the disk 88.

What we claim is:

1. A paper sheets processing apparatus for separating continuously fed paper sheets every predetermined number, comprising:

a chamber adapted to receive a stack of paper sheets;

means for introducing paper sheets into the stacking chamber, said means having an opening facing the stacking chamber and through which paper sheets can be introduced;

elongated separating means;

means for driving the separating means in the longitudinal direction to thereby cause the separating means to be completely drawn out of the stacking chamber;

rocking means for rocking the separating means from their normal horizontal position to a position slanted upward by a predetermined angle;

first adjusting means for adjusting the stacking chamber in the longitudinal direction so as to correspond to the size of paper sheets fed into the stacking chamber by the introducing means;

second adjusting means for adjusting the stacking chamber crosswise so as to correspond to the size of paper sheets introduced into the stacking chamber by the introducing means; and connecting means for causing the second adjusting means to operate associated with the adjusting operation of the first adjusting means.

2. A paper sheets processing apparatus according to claim 1 wherein the connecting means includes a first cam block mounted on the first adjusting means and having a tapered face, and a second cam block mounted on the second adjusting means and having a cam face which is urged to contact the cam face of the first cam block.

3. A paper sheets processing apparatus for separating continuously fed paper sheets every predetermined number comprising:

a chamber adapted to receive sheets stacked therein;

means for introducing paper sheets into the stacking chamber, said means having an opening facing the stacking chamber and through which paper sheets can be introduced;

elongated separating means including plurality of rod-like members spaced parallel from one another;

means for driving the separating means in the longitudinal direction to thereby cause the separating means to be completely drawn out of the stacking chamber;

rocking means for rocking the separating means from their normal horizontal position to a position slanted upward by a predetermined angle;

said driving means including a driving roller capable of rotating selectively in both directions around an axis and having an outer friction circumference, the driving roller contacting the rod-like separating members on the outer circumference thereof;

a guide roll assembly contacting the rod-like separating members, respectively in cooperation with the driving roller and sliding the rod-like separating members in the longitudinal direction thereof upon rotation of the driving roller; and a frame assembly rockable around said axis of the driving roller for mounting the guide roller assembly thereon.

4. A paper sheets processing apparatus for separating continuously fed paper sheets every predetermined number, comprising:

a chamber where paper sheets are stacked;

means for introducing paper sheets into the stacking chamber and having an opening facing the stacking chamber and through which paper sheets can be introduced;

elongated separating means comprising a plurality of rod-like members spaced parallel from one another;

means for driving the separating means in the longitudinal direction to thereby cause the separating means to be completely drawn out of the stacking chamber;

rocking means for rocking the separating means from their normal horizontal position to a position slanted upward by a predetermined angle;

the driving means including a driving roller capable of rotating selectively in both directions and having an outer friction circumference, the driving roller having the rod-like separating members contacted with the roller on the outer circumference thereof;

a guide roll assembly contacting the rod-like separating members, respectively, and cooperating with the driving roller, and guiding the rod-like separating members by the rotation of the driving roller to slide in the longitudinal direction; and a frame assembly for supporting the guide roll assembly rockable around an axial line;

the rocking means comprising pin means fixed to one of the rod-like separating members adjacent to the foremost end thereof, and a stop member attached to the frame assembly, whereby when the retreating stroke of the rod-like separating members in the longitudinal direction due to the rotation of the driving roller is finished, the pin means is stopped by the stop member to thereby cause the frame assembly to be rocked around the axial line and the rod-like separating members to be rocked from their normal horizontal position to their rocking position.

5. A paper sheets processing apparatus according to claim 3 further comprising locking means for releasably locking the separating means in the slanted position, said locking means including a toothed member mounted on the frame assembly, a latch member engageable with the toothed member, and an electromagnet for actuating the latch member.

6. A paper sheets processing apparatus according to claim 3 wherein the rod-like separator members are each made of pipe material and have a foremost end closed semispherical.

7. A paper sheets processing apparatus for separating continuously fed paper sheets every predetermined number, comprising:

a stacking chamber adapted to receive paper sheets stacked therein;

means for introducing paper sheets into the stacking chamber and having an opening facing the stacking chamer and through which paper sheets can be introduced;

elongated separating means;

means for driving the separating means in the longitudinal direction to thereby cause the separating means to be completely drawn out of the stacking chamber;

rocking means for rocking the separating means from their normal horizontal position to a position slanted upward by a predetermined angle;

beating means whose back ends are located outside the stacking chamber and whose free ends extend adjacent to the opening through which paper sheets are introduced into the stacking chamber;

means for intermittently and reciprocatingly driving the beating means to thereby cause the beating means to rock between their normal and beating positions and beat paper sheets fed by the introducing means so as to forcedly drop paper sheets into the stacking chamber;

a wall frame vertically erected to form one of side walls which define the stacking chamber crosswise;

means for adjusting and moving the wall frame in the longitudinal direction to various positions; and menas for changing the timing at which the beating means start their operation according to the amount of movement of the wall frame adjusted by the means for adjusting the wall frame in the longitudinal direction.

* * * * *